United States Patent [19]

Landen

[11] 3,951,289

[45] Apr. 20, 1976

[54] SAFETY-CLOSURE DEVICE

[75] Inventor: William James Landen, Cheshire, Conn.

[73] Assignee: Eyelet Specialty Co., Inc., Wallingford, Conn.

[22] Filed: July 8, 1971

[21] Appl. No.: 160,844

Related U.S. Application Data

[63] Continuation-in-part of Ser. No. 126,442, March 22, 1971, abandoned.

[52] U.S. Cl. ..... 215/211; 215/222

[51] Int. Cl.[2] ..... B65D 55/02

[58] Field of Search ..... 215/9, 44, 48, 40, DIG. 1, 215/211, 222; 220/42 C, 40, 40 S

[56] References Cited

UNITED STATES PATENTS

| | | | |
|---|---|---|---|
| 1,898,342 | 2/1933 | Cuthbert | 215/43 |
| 3,432,065 | 3/1969 | Bugla | 215/9 |
| 3,435,975 | 4/1969 | Weigand | 215/9 |
| 3,880,313 | 4/1975 | Akers | 215/222 |

*Primary Examiner*—George T. Hall

*Attorney, Agent, or Firm*—Hopgood, Calimafde, Kalil, Blaustein & Lieberman

[57] ABSTRACT

The invention contemplates selectively openable closure means that is tamper-proof, in the sense that a correct sequence of two deliberate and independent movements of two parts is necessary in order to achieve access to the contents of the bottle or the like which is protected by the closure.

The specific construction that is described involves a bottle with a neck having a circular opening, and a closure cap having a cylindrical wall to overlap and lock to the outer surface of the neck. The closed end of the cap has an axially projecting stiffly yieldable annular section which engages a chamber at the circular neck opening, in the course of closing the bottle. The nature of the lock is such as to avoid "plugged" closure and to compliantly preload the yieldable engagement, utilizing the resilient action to retain the lock and to establish a liquid seal of the bottle contents.

21 Claims, 5 Drawing Figures

INVENTOR
WILLIAM JAMES LANDEN
BY
Sandoe, Hopgood & Calimafde
ATTORNEYS

SAFETY-CLOSURE DEVICE

This application is a continuation-in-part of my copending application Ser. No. 126,442, filed Mar. 22, 1971, now abandoned.

This invention relates to tamper-proof selectively openable closure devices, as for closure of bottles containing liquid or solid matter that might be injurious when in unauthorized hands.

With recent growth in the use of drugs, pills, and the like, each with its specific prescribed purpose for a particular member of a household, there has been a corresponding increase in the chances for unauthorized access, particularly by small children. And it has become increasingly difficult, if not impossible, to supervise children enough to assure against their access to materials that can be harmful to them.

Accordingly, it is an object of the invention to provide a tamper-proof feature in containers for materials of the character indicated.

A specific object is to achieve the above-stated object with a construction in which a correct sequence of independent motions of two parts is a pre-requisite for access to the contents of the container.

Another object is to achieve the foregoing objects with a simple construction, involving the addition of no parts, beyond the container and its closure.

A further object is to provide a closure meeting the above objects and establishing a liquid seal.

A specific object is to provide a bottle and cap with integral locking and sealing formations which inherently achieve all the foregoing objects.

Another specific object is to achieve the stated objects using resilient deformable action of one of the parts to establish both a resiliently pre-loaded seal and resiliently pre-loaded lock retention; more specifically, it is an object to achieve smooth and continuously applicable resilient reaction-force development, over the axial range of relative positions of the parts, in the course of establishing locking and sealing functions. Also specifically, it is an object to achieve the foregoing objects with a molded-plastic cap construction incorporating stiffly compliant action available to continuously load a closure seal and lock, and having an inherent capacity to avoid loss of compliant action in spite of repeated application and removal of the closure.

Other objects and various further features of novelty and invention will be pointed out or will occur to those skilled in the art from a reading of the following specification in conjunction with the accompanying drawings. In said drawings, which show, for illustrative purposes only, a preferred form of the invention:

Figure 1:
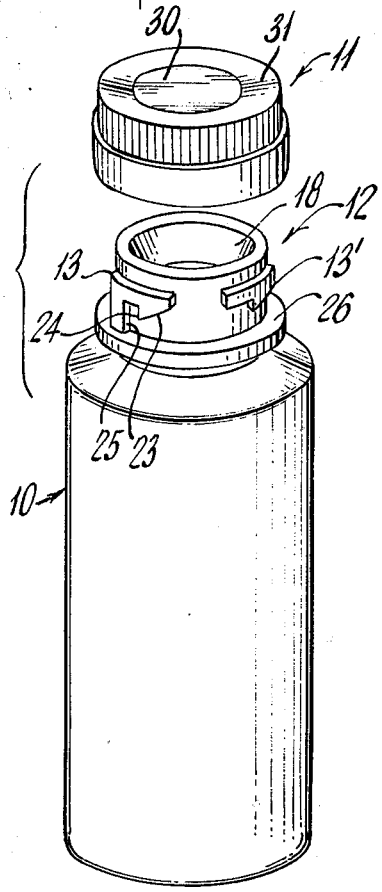
FIG. 1 is an exploded view in perspective showing a bottle, above which closure means of the invention is poised for application.
Figure 2:
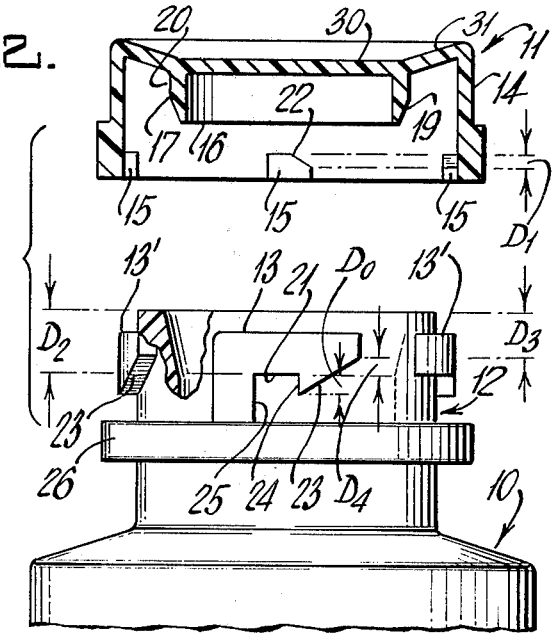
FIG. 2 is an enlarged exploded fragmentary view in elevation, certain parts being broken-away and shown in section.

In the drawings, the invention is shown in application to a bottle 10 and to a selectively removable closure cap 11 therefor. The bottle 10 may be of any suitable material but is conveniently of glass or plastic, being integrally formed with a reduced neck 12 having a circular axial-end opening to be selectively opened and closed by the cap 11. The bottle 10 is shown to be further integral with bayonet-type locking formations 13–13′ which project radially outwardly at angularly spaced locations on the neck 12.

The cap 11 is of deformable material such as a plastic having good memory, good flexural properties, a low coefficient of friction and relative inertness to most household chemicals; such materials include polypropylene, and polyethylene, each of which lends itself to injection-molding of the cap 11.

The cap 11 is generally cup-shaped, comprising an outer cylindrical wall portion 14 which is relatively thick (and therefore relatively rigid) and which telescopically overlaps the neck 12. The portion 14 includes angularly spaced integral inwardly projecting lugs 15, for bayonet-locking engagement with the neck formations 13–13′. The closed end of the cap features a downwardly extending axial projection 16 integrally connected to an axially yieldable closure wall; projection 16 is relied upon to establish closure and seal action, and the closed end of the cap is preferably relatively thin, to permit certain deformation, as will be explained in detail.

The closure-and-seal action of the invention occurs at essentially a single-line engagement which is circumferentially continuous, at a conically tapered counterbore 18 in the mouth of the neck opening. The edge is defined at a circumferentially continuous outer-part of the projection 16 and in the form shown is located at intersection between a chamfer 19 and the otherwise cylindrical surface 20 of the remainder of projection 16; the numeral 17 identifies this edge and intersection. The tapering slope $\alpha$ of the chamfer 19 exceeds the slope of the tapered counterbore 18, being preferably double or otherwise substantially exceeding the counterbore slope $\delta$ with respect to the central closure axis. Generally, angle $\alpha$ should be in the range 10° to 30° and angle $\delta$ in the range 8° to 15°, preference being indicated for $\alpha$ and $\delta$ at substantially 20° and 10°, respectively. The taper of counterbore 18 is generally frustoconical, having limiting radii $R_1 - R_2$ which may straddle the radial spread of the surface 19, thus including the radius $R_3$ of the edge 17, i.e., of the outer cylindrical surface 20 of projection 16; preferably, however, the radius at edge 17 (in the unstressed condition) slightly exceeds the maximum radius $R_2$ of the chamfer 18, as by two to seven percent of the radius $R_2$ .

In locked condition, the cap lugs 15 engage the recesses or undersides 21 of the formations 13–13′, and in this condition the edge 17 has engaged the neck counterbore 18, and is poised for a degree of deforming reaction therewith. Since cap 11 is of low-friction material, and since counterbore 18 is tapered, the compliant reaction to such deformation produced an axially separating force between neck 12 and cap 11, and this force resiliently loads and retains the bayonet engagement at 15–21. The same resilient action radially loads the edge 17 in its contact with counterbore 18, thus establishing a liquid-retaining seal of the contents of the bottle 10.

In accordance with a further feature of the invention, cam means are provided in the formations 13–13′–15, to permit the resilient deformations to take place in the course of the partial rotation which is involved in setting the bayonet lock. Such cam action is preferably operative for one direction of rotation (lock-setting), and not for the opposite direction of rotation, as will be explained.

As shown, each of the lugs 15 of the cap is provided with cam ramp 22, of rise $D_1$, and the bayonet formations 13–13' are similarly characterized by cam ramps, as at 23. The ramps 22–23 will be understood to engage in the course of clockwise cap rotation on the bottle. Preferably, the axially offset extent $D_2$ between the open end of neck 12 and the lug-seating surface 21 exceeds the corresponding offset $D_3$ for initial engagement of cam means 22–23, and the latter engagement occurs at or just beyond the axial location of initial edge-to-taper (counterbore) engagement, at 17–18. Also, the bayonet surface 21 is preferably axially offset to a substantial extent $D_0$ from the peak of cam 23, to establish a well-defined shoulder 24 against which the backside 24' of lug 15 will interfere, should one attempt to remove a locked cap through purely counterclockwise torque.

In use, an open bottle is closed by axially applying the cap 11 at an angular position such that lugs 15 pass between the respective bayonet formations 13–13'; such axial insertion will be free until initial edge-to-taper contact at 17–18. At this point, cam means 22–23 are in sufficient register to engage upon clockwise rotation of cap 11. In the course of such rotation, lug 15 rides up and over the peak of cam 23, against the relatively stiffly compliant displacement of the closure wall portion of cap 11 and against a degree yielding compression of the axial projection 16. Once over cam 23, lugs 15 snap back against surfaces 21, at which point the lock action is resiliently loaded and a circumferential seal action is resiliently loaded, both due to the described displacements and deformation, and to an extent $D_4$ proportional to the difference between offsets $D_2$ and $D_3$. As shown, at least one of the bayonet formations (13) includes an axial wall or rib 25, providing a firm limiting abutment for clockwise or lock-setting rotation.

The lock, thus set, remains positive and liquid sealing, and is secure against any attempted cap removal through purely counterclockwise (unthreading) torque. The only way to remove the cap 11 is by the deliberate further action of axially displacing cap 11 into further overlap with neck 12, until lugs 15 clear the peaks of cams 23. Such displacement is against elevated axial-force reaction through the line contact at 17–18 and must be held while thereafter rotating cap 11 counterclockwise. Such counterclockwise rotation will be limited by rib 25 at a location where cap 11 is freely axially removable, and a bottle flange 26 provides a circumferentially continuous bearing surface to limit axial displacement of the cap while performing the indicated partial rotation.

Figure 3:
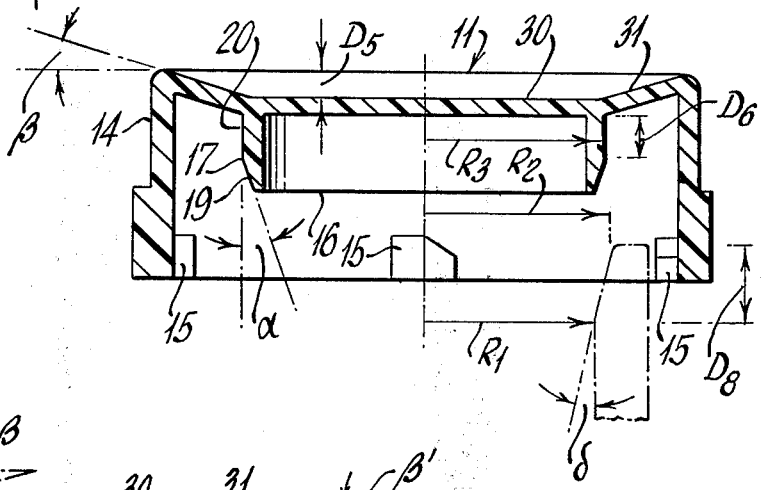
FIG. 3 is a further-enlarged sectional view of the cap of FIG. 2, for a better showing of dimensional proportions.

The specific nature of the indicated compliant reaction will be better grasped in a more detailed consideration of the described structure, best shown in FIG. 3. As already mentioned, the closure wall of cap 11 provides axially compliant suspension of the inner member 16 with respect to the outer member 14. For force analysis, it is convenient to refer to this closure wall as comprising a central radial disc 30 and a dished frusto-conical member 31 by which the suspended parts 16–30 are integrally connected to the outer member 14. The axially projecting cylindrical annulus 16 is integrally connected to this suspension, at juncture of elements 30–31, and the dished direction of member 31 is such that the concave surface thereof is outwardly exposed. All members 16–30–31 may be of essentially the same relatively thin proportions, in relation to the indicated relatively thick nature of the outer annulus 14. The flare or dished angle $\beta$ may be in the range of 10° to 20°, being preferably about 15°. In this context, the radially inward deformation, at line contact 17–18, will be seen to be of relatively limited extent, being essentially contour-adapting and seal-enhancing in nature, and limited by the circumferential compressibility of the seal-stressed region. In comparison with such compressibility limits, the frusto-conical section 31 is considerably more axially yieldable, in the direction which tends to flatten the same. For the indicated flare angle $\beta$ of 15°, a compliant axial displacement $D_5$ of the inner member 16 (with respect to outer member 14) is available in the amount of about 0.030 inch, before flattening the section 31; this specific displacement accommodation applies for a typical cap 11 to close a 0.5-inch neck bore wherein the section 31 spans a 1.100-inch bore diameter at 14 and a 0.785-inch diameter at 20. Such axial displacement amply accommodates the rise of cam 23 and assures substantial preload when snap-locked at 15–21 under a net axial preloading displacement $D_4$ which approximates the distance $D_2$–$D_3$.

It will be seen that the stiffly complaint reaction to flattening of member 31 is enhanced by accompanying radially compressive loading of disc 30 and by the relatively rigid nature of the outer annular member 14. And the relatively extensive axial range ($D_5$, greater than distance $D_4$) of such stiffly compliant deflection provides assurance of resiliently loaded seal and lock action, for repeated recycling of locking and unlocking operations. In particular, the inherently radialdeformation resistance of a flat disc (30) assures stiff inner radius reference for conical member 31 at all times, and the relative bulk and rigidity of the outer annular member 14 provide similar assurance and reference for the outer-radius reference of member 31.

By providing the steep flare $\beta$ at 31, there is assurance of a consistency and smoothness of developing axial-reaction force, as a function of deflection within the range $D_5$. No further deflection is needed at 31, so that the truncated cone of section 31 is never displaced past its "dead center" or flattened condition, and there is no discontinuity in that part of the deflection characteristic which is utilized. Stress-reversals at the zone of seal contact and in the conical member 31 are muted, and stable referencing is provided to retain the stress at all stress-loaded regions, with resultant longevity for the product and its effectiveness.

Figure 4:
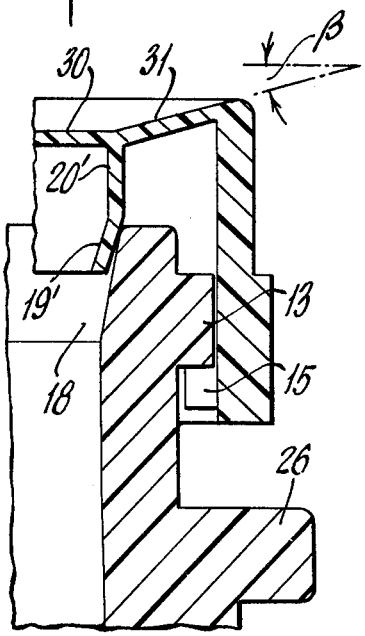
FIGS. 4 and 5 are enlarged fragmentary sectional views to show a modification, for respective situations of the parts ready for assembly, and assembled.
Figure 5:
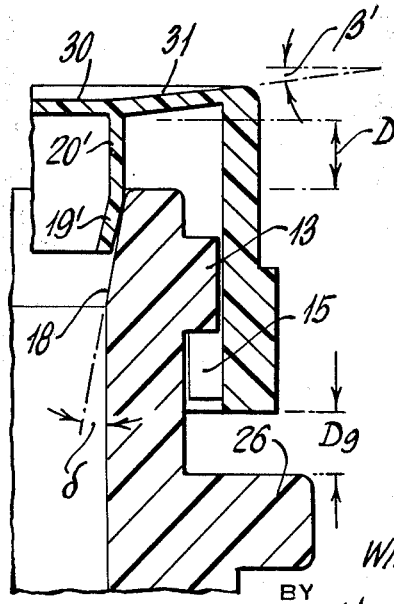

FIGS. 4 and 5 provide further detail of the action, in the context of the currently preferred form in which the axially projecting annulus 16' is of substantially uniform thickness, i.e., at both its cylindrical region 20' and its frusto-conical region 19'. Proportions and dimensions fall otherwise within the description already given. It is seen, by comparing the unassembled view (FIG. 4) with the assembled and secured view (FIG. 5), that for a cap taper angle $\alpha$ of about 18° reacting against a chamfer angle $\delta$ of about 10°, an initial (unstressed) cap dish angle $\beta$ of about 15° becomes about 7 degress ($\beta'$ in FIG. 5) when the lugs 15 have snapped into locking position; it is this 8° stressed deflection of the annular dish 31 which accounts for preloaded seal action at 17–18. Also, all compliant action is focussed at the contact region 17–18, since the end of the bottle clears the dish 31 by an amount $D_7$ greater than the rise of cams 23. Generally, thickness of dish 31 is selected, for the particular cap material, so as to require an axial force of 9 to 15 pounds to produce unlocking axial displacement, and to provide a drag reaction torque of 6 to 10 inch-pounds during unlocking partial rotation of the cap.

FIG. 5 also serves to illustrate that the axial clearance $D_9$ between cap 11 and flange 26 is less than the clearance $D_7$ between the open end of neck 12 and the adjacent part of cap 11 (underside of dish 31), thus enabling the bearing action described above.

The invention will be seen to achieve the stated objects and to provide a tamper-proof feature without adding to the number of required parts. Furthermore, pre-loaded liquid-sealing and pre-loaded locking action are the inherent result of the described coaction; the action provides effective locking and sealing of liquid contents under substantial differential pressures, as when carried in commercial high-altitude flight. Liquid-sealing is promoted by limited radially compressed deformation at 17–18 and by an accompanying axial distention (e.g. local widening of the circumferentially continuous line-contact 17–18), resulting in both axial and angular wiping contact in the course of establishing the seal. And by providing the radius $R_3$ at 17 equal to or slightly greater than the maximum radius $R_2$ of chamfer 18 (to the extent indicated), there is assurance that substantially all stiff axial force reaction is focussed at the indicated seal contact of edge 17 with chamfer 18.

While the invention has been described in detail for the preferred forms shown, it will be understood that modifications may be made without departure from the invention. For example, by providing the axial offset $D_6$ of edge 17 (with respect to conical member 31) less than the axial extent $D_8$ of counterbore 18, one is assured that the inner member 16 can never "plug" or stick in the bore of the bottle opening, no matter how badly the structure is abused by axial compression.

What is claimed is:

1. Tamper-proof selectively openable closure means, comprising a body including a neck with a circular axial-end opening having a conically tapered counterbore at the outward-end thereof, and a cap for selectively opening and closing said opening, said cap and the exterior of said neck having coacting telescoping parts for removably securing the same, and said coacting telescoping parts including axially extending means having circumferentially continuous resiliently loaded sealing contact with said opening when said cap is in secured position; said cap being of singlepiece integral molded plastic construction, comprising an outer relatively thick generally cylindrical annular portion having the means for removable securing to the exterior of said neck, a closure wall integrally and continuously and axially resiliently yieldably closing one axial end of said generally cylindrical portion, and a downwardly extending inner cylindrical sleeve projection radially spaced from said outer portion and connected to said outer portion via an integral and relatively thin annular portion of said closure wall, thereby establishing an axially yieldable connection of said sleeve projection and of said outer portion, said sleeve projection having a circumferentially continuous outwardly exposed edge short of the lower end of said sleeve projection and of substantially the maximum diameter of the taper of said counterbore, the lower end of said sleeve projection being characterized by an inwardly tapered relief below said edge, said edge interfering with said tapered counterbore in the course of establishing a secured cap and neck engagement, and the taper of said counterbore being of such axial extent that contact of said edge therewith is the only closure and sealing contact and is maintained throughout the range of relative axial displacement involved in establishing the disengaging a secured cap and neck engagement, whereby the essentially line-contact nature of edge-to-taper engagement assures against the cap ever "plugging" the neck opening, and whereby compliant axial deflection of said annular portion may provide a substantial axial preload upon said sealing contact.

2. Closure means according to claim 1, in which the axially yieldable annular portion of said closure wall is relatively thin and frusto-conical, and integrally connects said outer generally cylindrical portion to said inner cylindrical projection, said frusto-conical wall portion being concave on the outwardly exposed side of said cap.

3. Closure means according to claim 2, in which the flare angle of said frusto-conical portion is in the order of 10° to 20° from a radial plane through the axis of said cap.

4. Closure means according to claim 3, in which said flare angle is substantially 15°.

5. Closure means according to claim 1, in which the taper of said counterbore is in the order of 10° with respect to the axis of said cap.

6. Closure means according to claim 1, in which the downwardly projecting end of the outer surface of said inner cylindrical projection is a frusto-conical chamfer which extends axially for an end portion only of said inner projection, the taper angle of said chamfer with respect to the cap axis being greater than the corresponding taper angle of said counterbore, the intersection of said chamfer with the remaining outer surface of said projection defining said circumferentially continuous outwardly exposed edge.

7. Closure means according to claim 6, in which the taper angle of said counterbore is in the order of one half the taper angle of said chamfer.

8. Closure means according to claim 6, in which the taper angle of said counterbore is in the order of 10° and the taper angle of said chamfer is in the order of 20°.

9. Closure means according to claim 6, in which the cylindrical and chamfered parts of the outer surface of said inner projection are axially substantially coextensive.

10. Closure means according to claim 1, in which the axial extent of said tapered counterbore exceeds the axial distance from said edge to said closure wall, whereby neck contact with said closure wall will positively assure against said projection ever riding off the inner end of said counterbore to plug the neck opening.

11. Closure means according to claim 1, in which said neck and cap have bayonet-lock formations at the region of their telescoping overlap, whereby first axial and then radial manipulation are required to secure the cap to the neck, the axial displacement of said projection edge with respect to said tapered counterbore being such that in a sequence of actions to close the neck opening, edge-interference with the tapered counterbore occurs at a location sufficiently axially offset from the bayonet-lock position that said axially yieldable closure-wall position is held axially displaced when the closure is secured, thus establishing a resilient pre-load of a sealed edge-to-taper closure.

12. Closure means according to claim 11, in which the part of said closure wall which connects the inner projection with the outer cylindrical portion is frusto-conical and is concave on its outer exposed surface, whereby the axial deflection thereof to establish closure is in the direction of flattening said frusto-conical portion, so that accompanying radial compression of said part enhances axial compliance in the course of such flattening.

13. Closure means according to claim 12, in which the remaining part of said closure wall is a substantially flat radial section integrally connected to the radially inner limit of said frusto-conical portion at substantially the radius of integral connection of said projection thereto, whereby said flat radial section provides relatively stiff resistance to radial compression and therefore enhances the stiffness of axially compliant reaction upon closure operation.

14. Closure means according to claim 13, in which said bayonet-locking formations include an axial notch at an angular location following an angular region of axial-rise cam action, the axial depth of said notch being effectively less than the effective axial rise of said cam action, said edge-interference occurring substantially at the region of initial cam action, whereby after notch engagement said cap is retained on said neck with radial and axial loading of a sealed closure.

15. Closure means according to claim 6, in which the thickness of said projection is substantially uniform for both the cylindrical and chamfered portions thereof.

16. Closure means according to claim 6, in which the diameter of said edge exceeds the maximum diameter of the counterbore, to the extent of 2 to 7 percent of said maximum diameter.

17. Closure means according to claim 1, in which said neck includes a circumferentially continuous radially outward flange of at least substantially the maximum radius of said cap, the axial placement of said securing and sealing parts relative to the axial offset of said flange from the open end of said neck being such as to establish flange-cap interference while the open end of said neck is in axial clearance with the adjacent part of said cap.

18. A closure cap of single-piece molded plastic construction, comprising a relatively thick outer generally cylindrical annular portion having locking-lug means in the bore thereof for removably securing the cap to cooperating lug formations on a bottle neck, a closure wall integrally and continuously and axially resiliently yieldably closing one axial end of said generally cylindrical portion, and a downwardly extending inner cylindrical sleeve projection integral with an axially yieldable portion of said closure wall and having a circumferentially continuous outwardly exposed circular sealing edge at a location axially intermediate the ends of said cylindrical projection, said projection axially beyond said sealing edge being downwardly open and characterized by an inwardly converging taper and being radially inwardly deformable at least at the region of said sealing edge, and said projection being connected to said outer portion via an integral and relatively thin annular portion of said closure wall, thereby establishing an axially yieldable connection of said sleeve projection and of said outer portion, whereby compliant axial deflection of said annular portion may provide a substantial axial preload upon a sealing contact of said sealing edge with a suitable container neck to which said cap may be assembled.

19. A closure cap according to claim 18, in which the thickness of said projection is substantially uniform for both the cylindrical and inwardly tapered portions thereof.

20. A closure cap according to claim 18, in which the thickness of said projection at the axial region of said edge is relatively thin, the inner-wall surface of said inwardly tapered portion being inwardly tapered and smoothly faired into the inner wall at said region.

21. Closure means according to claim 1, in which the thickness of said sleeve projection at the axial region of said edge is relatively thin, the inner-wall surface at said inwardly tapered end being inwardly tapered and smoothly faired into the inner wall at said region.

* * * * *